US005183730A

United States Patent [19]

Yagi

[11] Patent Number: 5,183,730

[45] Date of Patent: Feb. 2, 1993

[54] SILVER HALIDE PHOTOGRAPHIC LIGHT-SENSITIVE MATERIAL IMPROVED IN GRADATION, PROCESSING STABILITY AND OTHER PROPERTIES

[75] Inventor: Toshihiko Yagi, Shiroyama, Japan

[73] Assignee: Konica Corporation, Tokyo, Japan

[21] Appl. No.: 591,975

[22] Filed: Oct. 2, 1990

[30] Foreign Application Priority Data

Oct. 4, 1989 [JP] Japan ..... 1-259529

[51] Int. Cl.[5] ..... G03C 1/46

[52] U.S. Cl. ..... 430/503; 430/567; 430/569; 430/571

[58] Field of Search ..... 430/503, 567, 571, 569

[56] References Cited

U.S. PATENT DOCUMENTS

| | | | |
|---|---|---|---|
| 4,565,778 | 1/1986 | Miyamoto et al. | 430/567 |
| 4,656,122 | 4/1987 | Sowinski et al. | 430/571 |
| 4,665,012 | 5/1987 | Sugimoto et al. | 430/567 |
| 4,668,614 | 5/1987 | Takada et al. | 430/567 |
| 4,692,400 | 9/1987 | Kumashiro et al. | 430/567 |
| 4,762,778 | 8/1988 | Yamazaki et al. | 430/567 |
| 4,865,964 | 9/1989 | Newmiller | 430/571 |
| 4,945,037 | 7/1990 | Saitou | 430/567 |
| 4,963,467 | 10/1990 | Ishikawa et al. | 430/567 |
| 4,990,437 | 2/1991 | Iijima et al. | 430/567 |
| 5,001,046 | 3/1991 | Honda et al. | 430/567 |
| 5,057,409 | 10/1991 | Suga | 430/567 |

FOREIGN PATENT DOCUMENTS

| | | |
|---|---|---|
| 0147854 | 7/1985 | European Pat. Off. . |
| 0202784 | 11/1986 | European Pat. Off. . |
| 0228914 | 7/1987 | European Pat. Off. . |

OTHER PUBLICATIONS

Patent Abstracts of Japan, vol. 12, No. 331 (P-755) [3178], Sep. 7, 1988.

*Primary Examiner*—Charles L. Bowers, Jr.
*Assistant Examiner*—Thomas R. Neville
*Attorney, Agent, or Firm*—Finnegan, Henderson, Farabow, Garrett and Dunner

[57] ABSTRACT

A silver halide photographic light-sensitive material improved in gradation and processing stability is disclosed. The material has a support and provided thereon a blue-sensitive emulsion layer, a green-sensitive emulsion layer and red-sensitive emulsion layer, wherein at least one of said color-sensitive emulsion layers contains; tabular silver halide grains having an aspect ratio of not less than 1.2; and core/shell type regular crystal silver halide grains of which the average projection area accounts for not more than 40% of that of the tabular grains.

24 Claims, No Drawings

SILVER HALIDE PHOTOGRAPHIC LIGHT-SENSITIVE MATERIAL IMPROVED IN GRADATION, PROCESSING STABILITY AND OTHER PROPERTIES

FIELD OF THE INVENTION

The present invention relates to a silver halide photographic light-sensitive material prepared by using a silver halide emulsion improved in sensitivity, graininess, gradation controllability and stability against the variation of processing conditions.

BACKGROUND OF THE INVENTION

With the recent progress of photographic technology, silver halide light-sensitive materials have attained remarkable improvement in both sensitivity and image quality. On the other hand, consumers' needs for a light-sensitive material have been more diversified than ever. Under such circumstance, a silver halide emulsion with improved gradation controllability has been acquiring importance. At the same time, there has been an increasing demand for a silver halide emulsion capable of providing excellent photographic properties irrespective of the variation of processing conditions such as developer temperature and development time.

As a method for obtaining a silver halide photographic light-sensitive material with improved sensitivity and image quality, Japanese Patent Publication Open to Public Inspection (hereinafter referred to as Japanese Patent O.P.I. Publication) No. 113934/1983 discloses the use of an emulsion comprising tabular silver halide grains having a grain diameter/grain thickness ratio of not less than 8, and Japanese Patent O.P.I. publication No. 143331/1985 disclosed the use of an emulsion comprising core/shell type silver halide grains each having a silver iodide-rich portion in the inside thereof.

These emulsions are defective in processability. In the case of the former emulsion, due to its tabular shape, the grain has an excessively high development activity in spite of its average silver iodide content, which makes it difficult to obtain a prescribed gradation. This emulsion is also poor in graininess.

Though improved in graininess, the latter emulsion cannot have such "a high development activity" as described in the specification as the effect of the invention. Contrary to the description in the specification, the grain contained in this emulsion has a poor development activity due to its high silver iodide content, which makes the emulsion have a poor gradation controllability. Efforts to enhance development activity by decreasing the average silver iodide content of a grain result in a lowered sensitivity.

By the preceding conventional techniques, it is impossible to obtain a silver halide emulsion having an appropriate development activity which permits easier gradation control for a prescribed development time, while maintaining sensitivity and graininess at higher levels.

SUMMARY OF THE INVENTION

The primary object of the present invention is to provide a silver halide photographic light-sensitive material prepared by using an emulsion improved in sensitivity and graininess and having an appropriate development activity.

The secondary object of the invention is to provide a silver halide photographic light-sensitive material improved in stability against the variation of processing conditions, and capable of providing gradation with sufficient linearity due to its excellent gradation controllability.

The above objects have been attained for the first time by the following light-sensitive material. The inventor did not expect the achievement of the second object. The preceding objects of the invention can be attained by a silver halide photographic light-sensitive material having a support and provided thereon at least one blue-sensitive emulsion layer, at least one green-sensitive emulsion layer and at least one red-sensitive emulsion layer, wherein at least one of said color-sensitive emulsion layers contains:

(a) a silver halide emulsion comprising tabular silver halide grains having an average grain diameter/grain thickness ratio of not less than 1.2; and (b) a silver halide emulsion comprising core/shell type regular crystal silver halide grains of which the average projection area accounts for not more than 40% of that of said tabular silver halide grains.

DETAILED DESCRIPTION OF THE INVENTION

In the light-sensitive material of the invention, at least one of emulsion layers contains the preceding Emulsion (a); an emulsion comprising not less than 50% by number of tabular silver halide grains having an average grain diameter/grain thickness ratio of not less than 1.2.

The average diameter of the tabular grains is preferably not less than 0.4 μm, more preferably 0.5 to 10 μm, most preferably 0.6 to 8 μm.

The average value of grain diameter/grain thickness ratios (hereinafter often referred to as an average aspect ratio) of the tabular grains is not less than 1.2, preferably 1.5 to 20, more preferably 1.8 to 10, most preferably 1.8 to 5.0.

The average thickness of the tabular grains is preferably not more than 0.50 μm, more preferably not more than 0.40 μm, most preferably 0.10 to 0.30 μm.

In the present invention, a grain diameter is defined as the diameter of a circle having the same area as that of the projected image of a grain, as viewed in an electron microphotograph of the grain.

A grain thickness is defined as the smallest value of distances between two faces of a grain which are parallel to each other.

The thickness of the tabular grain can be obtained by using an electron microphotograph of an emulsion in which the shadow of the grain appears. Alternatively, the thickness can be obtained by using an electron microphotograph of a cross section of a sample prepared by coating a support with a silver halide emulsion, followed by drying. To obtain an average aspect ratio, it is needed to employ at least 100 samples.

In Emulsion (a), the number of the tabular silver halide grains having an average aspect ratio of not less than 1.2 accounts for not less than 50%, preferably not less than 60%, more preferably not less than 70%, of the total number of silver halide grains contained in this emulsion (including tabular silver halide grains other than the mentioned above).

Generally and preferably, Emulsion (a) comprises only tabular silver halide grains.

Emulsion (a) is preferably a silver iodobromide or silver bromide emulsion, but may contain other silver halides such as silver chloride as long as the effects of the invention are not impaired.

The preceding tabular silver halide grains having an average aspect ratio of not less than 1.2 are preferably silver halide grains in each of which silver iodide is localized in the central portion thereof.

The expression "silver iodide is localized in the central portion thereof" means a condition in which the average silver iodide content ($J_1$) obtained by the X-ray fluorometry and the average value of silver iodide contents ($J_3$) each obtained by the X-ray microanalysis method at a portion of not less than 80% away from the central portion of a grain in the direction of its diameter satisfies the following relationship:

$$J_1 > J_3$$

The "central portion of a grain" as referred to herein means the center of the circumcircle of a grain, as viewed from the direction in which the projected area of the grain reaches its maximum.

An explanation will be made on the X-ray microanalysis method. Silver halide grains were dispersed on a grid for an electron microscopic examination, which had been prepared by attaching an energy diffusion-type X-ray analyzer to an electron microscope. The magnification was set by chilling with liquid nitrogen in such a way that one grain came within an analyzing field. For a predetermined period of time, the intensities of an AgL ray and an IL ray were integrated. The silver iodide content was calculated from the intensity ratio of I L to AgL , by using a calibration curve which had been prepared in advance.

The average value of silver iodide contents of the preceding tabular silver halide grains each obtained by the X-ray microanalysis method at a portion of not less than 80% away from the central portion of a grain in the direction of its diameter ($J_3$) is preferably 6 to 0 mol %, more preferably 5 to 0 mol %, most preferably 4 to 0.01 mol %.

The maximum value of silver iodide contents each obtained by the X-ray microanalysis method at a portion of not more than 80% away from the central portion of a grain in the direction of its diameter ($J_2$) is preferably 10 to 40 mol %, more preferably 15 to 35 mol %.

The silver iodide content of Emulsion (a) is preferably not more than 20 mol %, more preferably 2 to 15 mol %, most preferably 4 to 12 mol %.

An emulsion comprising tabular silver halide grains which is usable as Emulsion (a) can be prepared with reference to the methods described in Japanese Patent O.P.I. Publication Nos. 113926/1983, 113927/1983, 113934/1983, 1855/1987, European Patent Nos. 219,849 and 219,850.

An emulsion comprising monodispersed tabular silver halide grains can be prepared with reference to the methods described in Japanese Patent O.P.I. Publication Nos. 6643/1986 and 14636/1986.

An emulsion comprising tabular silver iodobromide grains having an average aspect ratio of not less than 1.2 can be prepared by adding a silver nitrate solution or simultaneously adding a silver nitrate solution and a halide solution to a gelatin-containing solution with a pBr value of not more than 4 to form seed crystals, and growing these seed crystals by the double-jet method.

The size of a tabular silver halide grain can be controlled by grain formation temperature and the rate of adding a silver salt solution and a silver halide solution.

The average silver iodide content of tabular silver halide grains contained in a silver iodobromide emulsion can be controlled by varying the composition of a halide solution to be added; i.e., the ratio of a bromide to an iodide.

If need arises, a silver halide solvent such as ammonia, thioether and thiourea can be employed in the preparation of tabular silver halide grains.

Next, an explanation will be made on Emulsion (b) which is contained in the same color-sensitive layer as that in which the preceding Emulsion (a) is contained. Silver halide grains contained in Emulsion (b) are core/shell type regular crystal grains.

The regular crystals, which have no twin plane are preferably regular cubic, octahedral, dodecahedral, tetradecahedral, trisoctahedral or spherical crystals. As to crystals other than spherical crystals, the proportion of the (1.0.0) face to the (1.1.1) face is not critical.

The face proportion of a silver halide grain can be measured by the following X-ray diffraction method:

On a flat plate, a silver halide grain sample which had been subjected to orientation was provided. The diffraction pattern of each of the (1.0.0), (1.1.0) and (1.1.1) faces was obtained under the following conditions:

Target: Cu

Source: K$\alpha$ ray of Cu

Tube voltage: 30 kV

Tube currency: 10 mA

As a result, a diffraction peak (A) derived from the (1.0.0) face was observed at a diffraction angle ($2\theta$) of 29 to 33 degrees, a diffraction peak (B) derived from the (1.1.0) face was observed at a diffraction angle ($2\theta$) of 43 to 47 degrees, and a diffraction peak (C) derived from the (1.1.1) face was observed at a diffraction angle ($2\theta$) of 53 to 57 degrees. Based on the peak intensity of each face, the face proportion can be obtained by the following equation:

(Example) Calculation of the proportion of the (1.0.0) face $$\frac{\frac{A}{1}}{\frac{A}{1} + \frac{B}{0.55} + \frac{C}{0.16}} \times 100$$

1: Appearance probability of the (1.0.0) face of silver bromide 0.55: Appearance probability of the (1.1.0) face of silver bromide 0.16: Appearance probability of the (1.1.1) face of silver bromide The proportions of the (1.1.0) and (1.1.1) faces can be obtained in the same method as mentioned above.

In the preceding regular crystal emulsion, the proportion of the (1.1.1) face is preferably not less than 20%, more preferably not less than 70%.

As described in Japanese Patent O.P.I. Publication Nos. 182730/1982, 179344/1986 and 178447/1986, spherical silver halide grains can be obtained by subjecting formed silver halide grains to physical ripening in the presence of a solvent for a silver halide.

The "spherical" as referred to herein means a condition in which each angle of a polygon forming the outline of a silver halide grain has a roundness at its angle, of which the radius of curvature is 1/6 l to 1/2 l, wherein l is the length of the longest side of the largest plane of this polygon.

The roundness of a grain can be obtained by an electron microscopic observation.

When the core/shell type grain is a silver iodobromide grain, it consists of two or more layers differing in silver iodide content. It is preferred that a layer with the largest silver iodide content be located other portions than the outermost surface layer (hereinafter referred to as the "shell").

An innermost layer (hereinafter referred to as "core") with the largest silver iodide content preferably has a silver iodide content of not less than 10 mol %, more preferably not less than 15 mol %, most preferably 20 to 40 mol %. The outermost surface layer preferably has a silver iodide content of smaller than 6 mol %, more preferably 0 to 4.0 mol %.

In the core/shell type grain, the volume of the shell portion accounts for preferably 10 to 80%, more preferably 15 to 70%, of the entire grain.

In the invention, when the core/shell type grain is a silver iodobromide grain, the silver iodide content may change from the core to shell portions with a sharp boundary, or continuously without such boundary. It is preferred that the change in silver iodide content from the core to shell portions have a sharp boundary. It is also preferred that a intermediate layer of which the silver iodide content is intermediate between the silver iodide content of the core and that of the shell be provided between the core and shell.

When the core/shell type grain has the intermediate layer, the volume of the intermediate layer accounts for preferably 5 to 60%, more preferably 20 to 55%, of the total volume of the grain.

The silver iodide content of the shell differs from that of the intermediate layer preferably by not less than 6 mol %. The silver iodide content of the intermediate layer differs from that of the core preferably by not less than 6 mol %. It is preferred that the shell and the core differ in silver iodide content by not less than 12 mol %.

In the invention, the core/shell type silver halide emulsion used as Emulsion (b) preferably has an average silver iodide content of 4 to 20 mol %, more preferably 5 to 15 mol %. The emulsion may contain silver chloride as long as the effects of the invention are not impaired.

The core/shell type emulsion used in the invention can be prepared by the methods described in Japanese Patent O.P.I. Publication Nos. 177535/1984, 138538/1985, 52238/1984, 143331/1985, 35726/1985 and 258536/1985. As described in the examples of Japanese Patent O.P.I. Publication No. 138538/1985, it is preferred that a core/shell type grain be grown with a seed crystal. When a grain is grown with a seed crystal, the central portion of the grain may have a site with a halogen composition different from that of the core. In this case, the halogen composition of a seed crystal is not critical. Use can be made of silver bromide, silver iodobromide, silver chloroiodobromide, silver chlorobromide, silver chloride, or the like, but it is preferable to employ silver iodobromide or silver bromide with a silver iodide content of not more than 10 mol %.

The volume of a seed grain accounts for preferably not more than 50%, more preferably not more than 10%, of the total volume of a silver halide grain.

It is also preferred that the core/shell type grain be grown by effecting a halide conversion generally with an iodide immediately before or after the formation of the core or the intermediate layer.

The distribution of silver iodide in the core/shell type silver halide grain can be examined by various physical measurement methods, such as the X-ray diffraction method and the measurement of luminescence at low temperatures as described in the Lists of Lectures at the 1981 Annual Meeting of the Society of Photographic Science and Technology of Japan.

Known silver halide solvents such as ammonia, thioether and thiourea may be used in growing the core/shell type silver halide grain.

During nucleating and/or growing the core/shell type silver halide grain, a metal ion may be added so that it is contained in the inside and/or on the surface of the grain by using at least one member selected from cadmium salts, zinc salts, lead salts, thallium salts, salts or complex salts of iridium, salts or complex salts of rhodium and salts or complex salts of iron. A reduction sensitization nucleus can be formed in the inside and/or on the surface of the grain in a reductive atmosphere.

Unnecessary soluble salts may or may not be removed after the growth of a silver halide grain. The removal of such salts can be performed by the method described in Section II of Research Disclosure (hereinafter abbreviated as RD) No. 17643.

The core/shell type grain may be such that a latent image is formed mainly on its surface or its inside.

The size of the core/shell type silver halide grain is preferably 0.1 to 10 μm, more preferably 0.2 to 5 μm, most preferably 0.3 to 2 μm.

The grain size distribution of the core/shell type silver halide emulsion is not critical, and it may be either polydispersed (having a wider grain size distribution) or monodispersed (having a narrower grain size distribution). A combination of two or more monodispersed emulsions or a combination of a monodispersed emulsion and a polydispersed emulsion is also usable.

In the invention, it is preferred that silver halide emulsions used as Emulsions (a) and (b) be monodispersed emulsions.

The "monodispersed emulsion" as referred to herein means an emulsion in which the weight of silver halide grains having grain sizes falling within the range of ±20% of the average grain size ($\bar{r}$) accounts for not less than 60%, preferably not less than 70%, most preferably not less than 80%, of the total weight of silver halide grains.

The average grain size ($\bar{r}$) as referred to herein means a diameter (ri) which makes the value of $ni \times ri^3$ reach a maximum (wherein ni represents the frequency of a silver halide grain with a diameter of di (the value is rounded to three effective figures).

The grain size can be obtained by actually measuring the diameter of a grain in an electron microphotograph at magnification of 10,000 to 50,000 x, or alternatively, by measuring the area of the projected image of a grain. (Measurement is done with respect to not less than 1,000 grains selected arbitrarily.)

In the invention, the width of distribution of a highly monodispersed emulsion which can advantageously be employed as Emulsion (b) is preferably not more than 20%, more preferably not more than 15%. The width of distribution (so-called coefficient of varification) is defined by the following formula:

$$\frac{\text{Standard deviation}}{\text{Average grain size}} \times 100 = \text{Width of distribution}$$

In the above formula, the average grain size means the arithmetic average grain size.

A monodispersed emulsion can be obtained by adding to a gelatin-containing solution containing seed grains an aqueous silver salt solution and an aqueous halide solution by the double-jet method while controlling pAg and pH.

The rate of adding of these solutions can be determined with reference to Japanese Patent O.P.I. Publication Nos. 48521/1979 and 49938/1983.

A still more highly monodispersed emulsion can be obtained by growing silver halide grains in the presence of tetrazaindene disclosed in Japanese Patent O.P.I. Publication No. 122935/1985.

As to the mixing ratio of Emulsion (a) and Emulsion (b), the silver weight ratio of Emulsion (b) to the mixture of Emulsions (a) and (b) is preferably less than 80%, more preferably less than 60%, most preferably 5 to 50%.

A color-sensitive emulsion layer containing the preceding tabular silver halide grains and core/shell type silver halide grains may contain other silver halide grains in such an amount as will not affect adversely the effects of the invention.

Silver halide emulsions usable in other emulsion layers than that contains the preceding Emulsions (a) and (b) include any of conventional silver halide emulsions.

In the invention, the average projection area of the regular crystal core/shell type silver halide grains accounts for not more than 40%, preferably 1 to 35%, more preferably 3 to 20%, most preferably 5 to 15%, of the average projection area of the tabular silver halide grains with an average aspect ratio of not less than 1.2.

Silver halide emulsions used in the light-sensitive material of the invention may contain such an agent as an antifoggant and a stabilizer. Gelatin can be advantageously employed as a binder.

Emulsion layers and other hydrophilic colloid layers may be hardened, and may contain a plasticizer and a dispersion product (latex) of a synthetic polymer which is slightly or sparingly soluble in water.

When the present invention is applied to a color photographic light-sensitive material (e.g., a color negative film, a color reversal film), an emulsion layer may contain a coupler.

In this case, use can be made of a colored coupler having a function of color correction, a competing coupler and a compound which can release, by a coupling reaction with an oxidized product of a developing agent, various photographically effective fragments such as a development accelerator, a developing agent, a silver halide solvent, a toning agent, a hardener, a fogging agent, an antifoggant, a chemical sensitizer, a spectral sensitizer and a desensitizer.

Auxiliary layers such as a filter layer, an anti-halation layer and an anti-irradiation layer may be provided in the light-sensitive material. These layers and/or emulsion layers may contain a dye which flows out from the light-sensitive material or bleached during development.

The light-sensitive material may contain a formalin scavenger, a fluorescent bleaching agent, a matting agent, a lubricant, an image stabilizer, a surfactant, an anti-color fogging agent, a development accelerator, a development retarder and a bleaching accelerator.

Usable supports include any conventional support such as polyethylene-laminated paper, a polyethylene terephthalate film, a baryta paper and a cellulose triacetate film.

EXAMPLES

The present invention will be described in more detail with reference to the following examples, which should not be construed as limiting the scope of the invention.

EXAMPLE 1 Preparation of an emulsion comprising tabular silver halide grains with a high average aspect ratio (Emulsion a)

According to the method described in Japanese Patent O.P.I. Publication No. 14636/1986, three inventive silver iodobromide emulsions (Em-1 to 3) each comprising tabular silver halide grains were prepared. The average silver iodide content, the number proportion of the tabular grains with an aspect ratio of not less than 1.2 to other grains, the average grain diameter and the width of distribution of each emulsion are shown in Table 1. In each emulsion, a grain had a silver iodide-localized site in its central portion. The average silver iodide content was indicated by the value of $J_3$. The values of $J_1$ and $J_2$ were also shown in Table 1.

TABLE 1

| Emulsion No. | Silver iodide content $J_1$ | $J_2$ | $J_3$ | Proportion of tabular grains (percent by number) | Average aspect ratio | Average grain diameter | Width of distribution |
|---|---|---|---|---|---|---|---|
| Em - 1 | 8 | 30 | 0 | 82 | 4.2 | 1.40 | 14 |
| Em - 2 | 8 | 30 | 0.3 | 85 | 3.6 | 1.30 | 14 |
| Em - 3 | 10 | 35 | 0.3 | 85 | 2.3 | 1.15 | 13 |

EXAMPLE 2 Preparation of an emulsion comprising regular crystal grains (Emulsion (b))

Four silver iodobromide emulsions Em-4 to 7 having properties as shown in Table 2 were prepared. Em-4, 6 and 7 were each prepared by growing seed crystals by the double-jet method according to the method described in Japanese Patent O.P.I. Publication No. 143331/1985. Em-5 was obtained by preparing a monodispersed core/shell type emulsion and subjecting it to ripening at a pAg value of 10.5.

TABLE 2

| Emulsion No. | Silver iodide content (%) Core | shell (inner layer) | Shell (outer layer) | Average | Average grain size (μm) | Width of distribution (%) | Shape of grain |
|---|---|---|---|---|---|---|---|
| Em - 4 | 40 | 15 | 0.3 | 6 | 0.45 | 12 | Octahedral |
| Em - 5 | 35 | — | 0.1 | 8 | 0.38 | 12 | Spherical |
| Em - 6 | 30 | 15 | 0.5 | 8 | 0.38 | 13 | Octahedral |

TABLE 2-continued

| Emulsion No. | Silver iodide content (%) Core | shell (inner layer) | Shell (outer layer) | Average | Average grain size (μm) | Width of distribution (%) | Shape of grain |
|---|---|---|---|---|---|---|---|
| Em - 7 | 30 | 15 | 0.5 | 8 | 0.32 | 13 | Octahedral |

EXAMPLE 3

On a cellulose triacetate film support, layers with the following composition were provided in sequence from the side of the support, thereby to obtain a multi-layer color photographic light-sensitive material (Sample 1). The amount of each ingredient was indicated by g/m$^2$ unless otherwise indicated. The amounts of a silver halide and a colloidal silver were each indicated as the amount converted to silver.

Em-1 to 7 prepared in Example 1 and 2 were each subjected to chemical ripening in the presence of sodium thiosulfate, chloroauric acid and ammonium thiocyanate. The emulsions were then divided, followed by addition of sensitizing dyes S-1 to 3, S-6 to 8 and S-9 and 10 and 4-hydroxy-6-methyl-1,3,3a-7-tetrazaindene as a stabilizer. Samples 2 to 10 were prepared by using these emulsions.

| Layer structure of Sample 1 | |
|---|---|
| 1st layer: anti-halation layer (HC-1) | |
| Black colloidal silver | 0.20 |
| UV absorbent (UV-1) | 0.20 |
| High boiling solvent (Oil-1) | 0.20 |
| Gelatin | 1.5 |
| 2nd layer: intermediate layer (IL-1) | |
| UV absorbent (UV-1) | 0.01 |
| High boiling solvent (Oil-1) | 0.01 |
| Gelatin | 1.5 |
| 3rd layer: low red-sensitive emulsion layer (RL) | |
| Silver iodobromide emulsion (the following emulsion A) | 0.9 |
| Silver iodobromide emulsion (the following emulsion B) | 0.6 |
| Sensitizing dye (S-1) | $2.5 \times 10^{-4}$ (mol per mol silver) |
| Sensitizing dye (S-2) | $2.5 \times 10^{-4}$ (mol per mol silver) |
| Sensitizing dye (S-3) | $0.5 \times 10^{-4}$ (mol per mol silver) |
| Cyan coupler (C-1) | 1.0 |
| Cyan coupler (C-2) | 0.05 |
| Colored cyan coupler (CC-1) | 0.05 |
| DIR compound (D-1) | 0.002 |
| High boiling solvent (Oil-1) | 0.5 |
| Gelatin | 1.5 |
| 4th layer: high red-sensitive emulsion layer (RH) | |
| Silver iodobromide emulsion (the following emulsion C) | 2.0 |
| Sensitizing dye (S-1) | $2.0 \times 10^{-4}$ (mol per mol silver) |
| Sensitizing dye (S-2) | $2.0 \times 10^{-4}$ (mol per mol silver) |
| Sensitizing dye (S-3) | $0.1 \times 10^{-4}$ (mol per mol silver) |
| Cyan coupler (C-2) | 0.015 |
| Cyan coupler (C-3) | 0.25 |
| Colored cyan coupler (CC-1) | 0.015 |
| DIR compound (D-2) | 0.05 |
| High boiling solvent (Oil-1) | 0.3 |
| Gelatin | 1.5 |
| 5th layer: intermediate layer (IL-1) | |
| 6th layer: low green-sensitive emulsion layer (GL) | |
| Silver iodobromide emulsion (the following Emulsion A) | 1.0 |

-continued

| Layer structure of Sample 1 | |
|---|---|
| Sensitizing dye (S-4) | $5 \times 10^{-4}$ (mol per mol silver) |
| Sensitizing dye (S-5) | $1 \times 10^{-4}$ (mol per mol silver) |
| Magenta coupler (M-1) | 0.5 |
| Colored magenta coupler (CM-1) | 0.01 |
| DIR compound (D-3) | 0.02 |
| DSR compound (D-4) | 0.020 |
| High boiling solvent (Oil-2) | 0.4 |
| Gelatin | 1.0 |
| 7th layer: intermediate layer (IL-3) | |
| Gelatin | 0.8 |
| 8th layer: high green-sensitive emulsion layer (GH) | |
| Silver iodobromide (the following Emulsion C) | 1.3 |
| Sensitizing dye (S-6) | $1.5 \times 10^{-4}$ (mol per mol silver) |
| Sensitizing dye (S-7) | $2.5 \times 10^{-4}$ (mol per mol silver) |
| Sensitizing dye (S-8) | $0.5 \times 10^{-4}$ (mol per mol silver) |
| Magenta coupler (M-2) | 0.05 |
| Magenta coupler (M-3) | 0.15 |
| Colored magenta coupler (CM-2) | 0.05 |
| DIR compound (D-3) | 0.01 |
| High boiling solvent (Oil-3) | 0.5 |
| Gelatin | 1.0 |
| 9th layer: yellow-filter layer (YC) | |
| Yellow colloidal silver | 0.1 |
| Anti-stain agent (SC-1) | 0.1 |
| High boiling solvent (Oil-3) | 0.1 |
| Gelatin | 0.8 |
| 10th layer: low blue-sensitive emulsion layer (BL) | |
| Silver iodobromide emulsion (the following Emulsion A) | 0.25 |
| Silver iodobromide emulsion (the following Emulsion B) | 0.25 |
| Sensitizing dye (S-10) | $7 \times 10^{4}$ (mol per mol silver) |
| Yellow coupler (Y-1) | 0.5 |
| Yellow coupler (Y-2) | 0.1 |
| DIR compound (D-2) | 0.01 |
| High boiling solvent (Oil-3) | 0.3 |
| Gelatin | 1.0 |
| 11th layer: high blue-sensitive layer (BH) | |
| Silver iodobromide emulsion (the following Emulsion C) | 0.7 |
| Sensitizing dye (S-9) | $1 \times 10^{-4}$ (mol per mol silver) |
| Sensitizing dye (S-10) | $3 \times 10^{-4}$ (mol per mol silver) |
| Yellow coupler (Y-1) | 0.30 |
| Yellow coupler (Y-2) | 0.05 |
| High boiling solvent (Oil-3) | 0.1 |
| Gelatin | 1.1 |
| 12th layer: 1st protective layer (PRO-1) | |
| Fine-grained silver iodobromide emulsion (average grain size: 0.08 μm, AgI content: 2 mol %) | 0.4 |
| UV absorbent (UV-1) | 0.10 |
| UV absorbent (UV-2) | 0.05 |
| High boiling solvent (Oil-1) | 0.1 |
| High boiling solvent (Oil-4) | 0.1 |
| Formalin scavenger (HS-1) | 0.5 |
| Formalin scavenger (HS-2) | 0.2 |
| Gelatin | 1.0 |
| 13th layer: 2nd protective layer (PRO-2) | |
| Surfactant (SU-1) | 0.005 |

-continued

| Layer structure of Sample 1 | |
|---|---|
| Alkaline-soluble matting agent (average grain size: 3 μm) | 0.10 |
| Gelatin | 0.6 |

Emulsion A: a monodispersed emulsion comprising silver iodobromide grains each having a low silver iodide content on its surface (average grain size: 0.45 μm, average silver iodide content: 8.0 mol %)

Emulsion B: a monodispersed silver iodobromide emulsion having a uniform composition, an average grain size of 0.30 μm and an average silver iodide content of 2.0 mol %.

Emulsion C: a silver iodobromide emulsion comprising octahedral grains and having an average grain size of 0.80 μm, an average silver iodide content of 9.0 mol %, a width of distribution of 11%, a silver iodide content of the core of 35 mol % and a silver iodide content of the shell of 0.3 mol %.

To each layer, a coating aid (SU-2), a stabilizer (Stb-1) and an antifoggant (AF-1) were added.

S-1

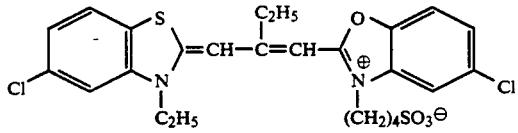

S-2

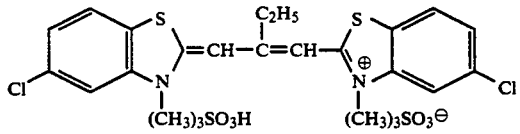

S-3

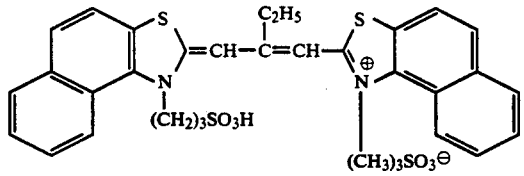

S-4

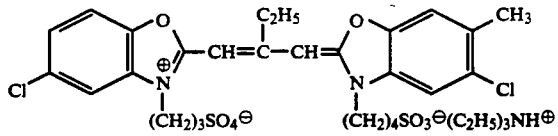

S-5

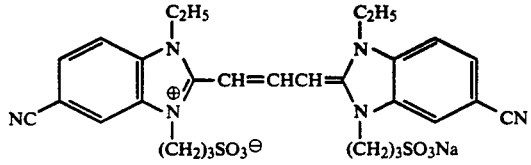

S-6

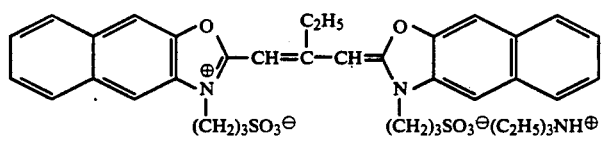

S-7

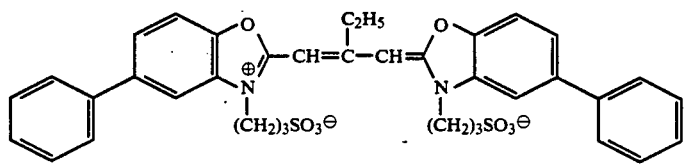

S-8

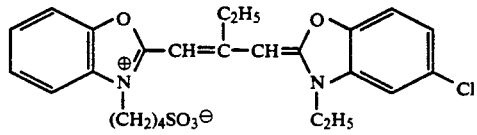

-continued
S-9
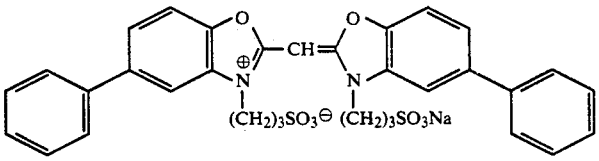
S-10
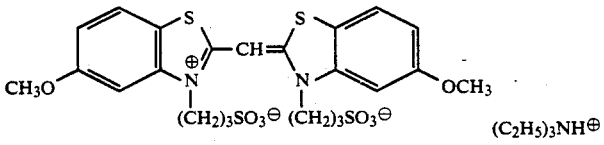
C-1
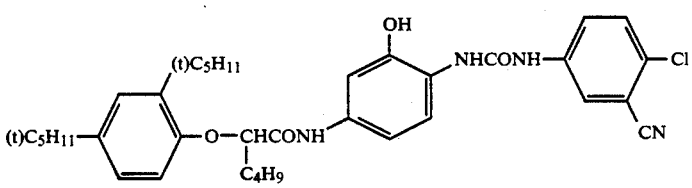
C-2
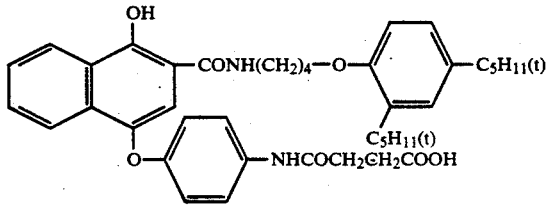
C-3
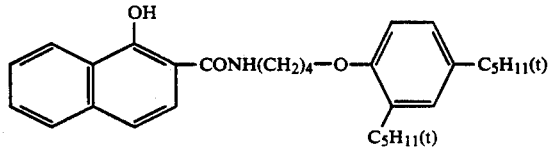
M-1
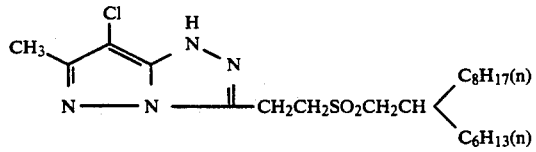
M-2
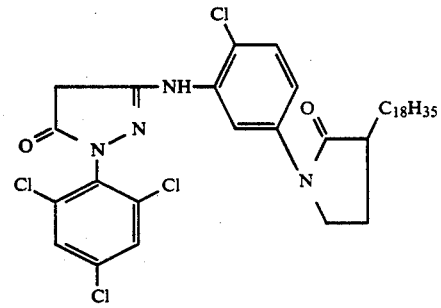

-continued
M-3
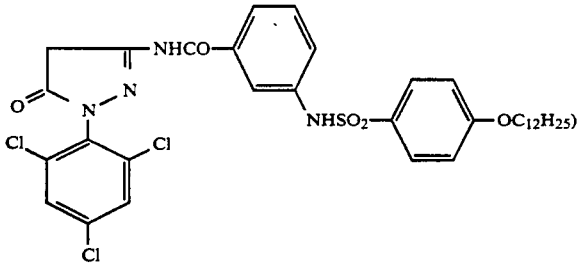
Y-1
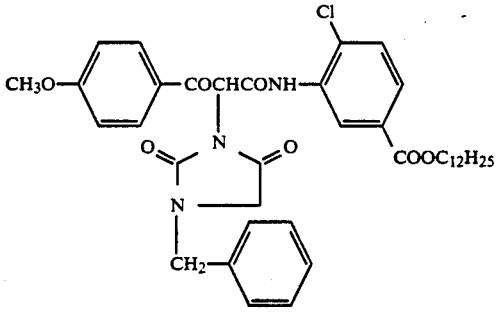
Y-2
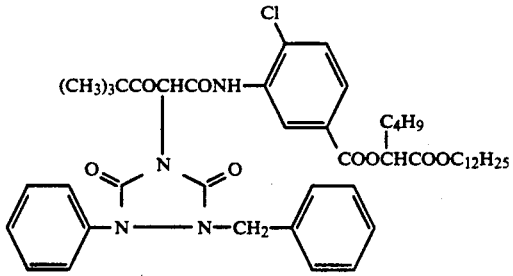
CC-1
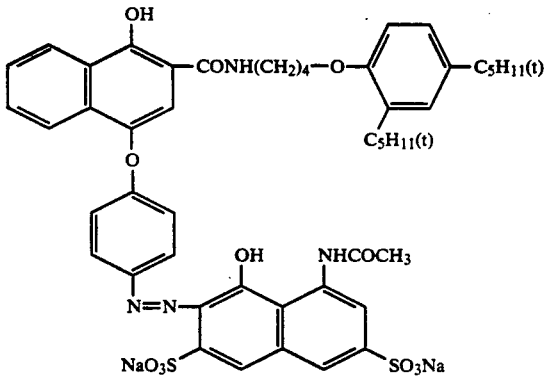
CM-1
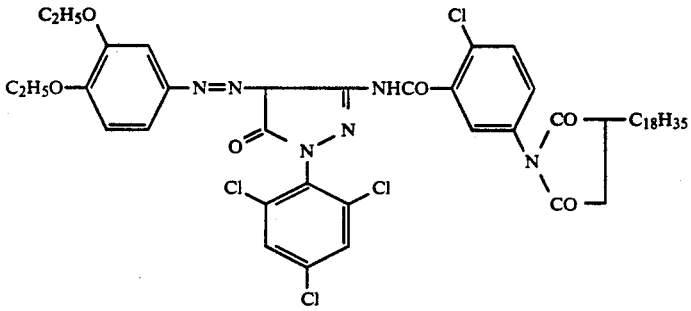

-continued
CM-2
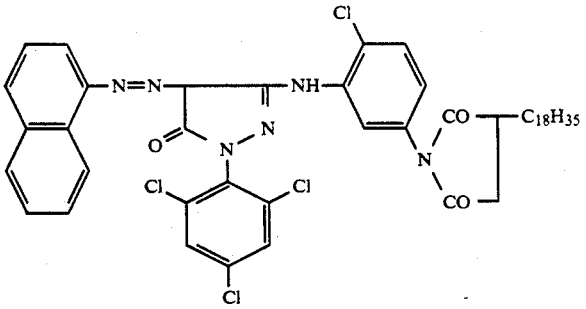
D-1
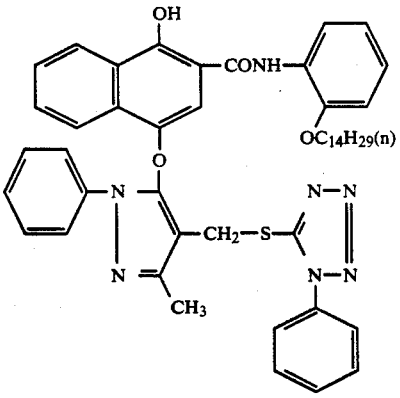
D-2
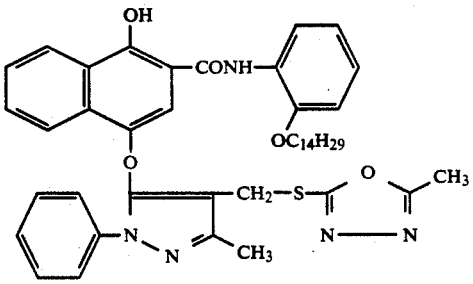
D-3
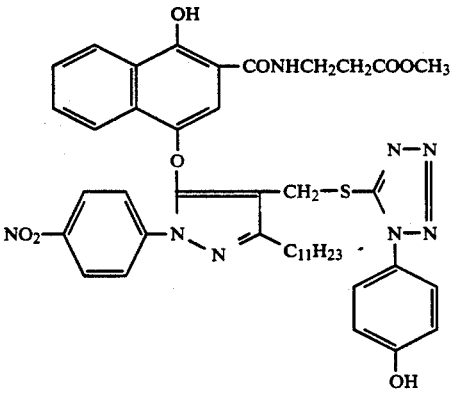

-continued
D-4
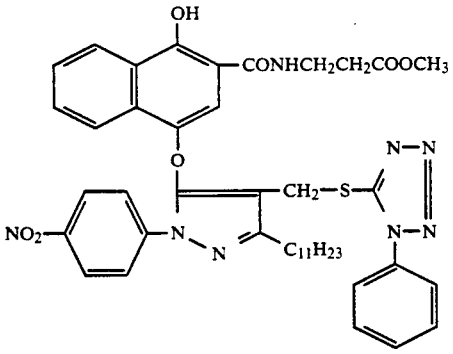
UV-1
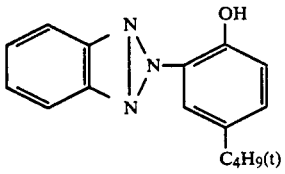
UV-2
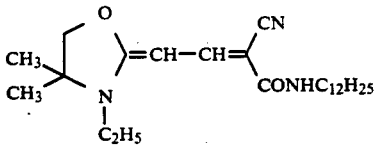
HS-1
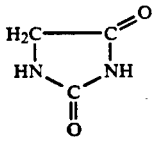
HS-2
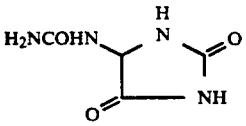
H-1
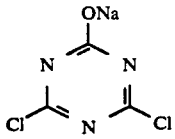
H-2
$[(CH_2{=}CHSO_2CH_2)_3CCH_2SO_2(CH_2)_2N(CH_2)_2SO_3K$
Su-1
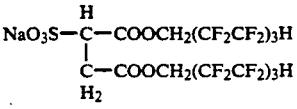
Su-2
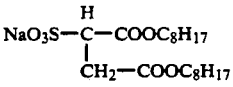
Su-3
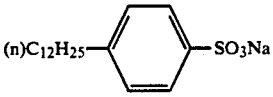

-continued

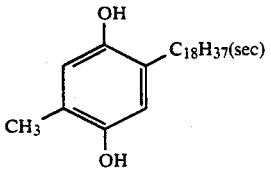

SC-1

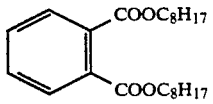

Oil-1

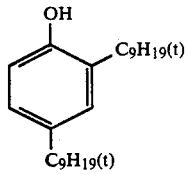

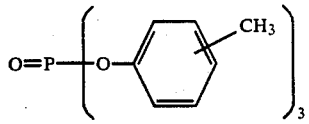

Oil-3

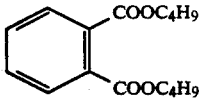

Oil-4

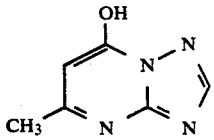

Stab-1

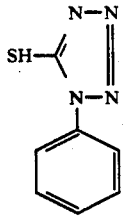

AF-1

Samples 2 to 10 were prepared in the same manner as in the preparation of Sample 1, except that Emulsion C was replaced with the emulsions shown in Table 3.

TABLE 3

| Sample No. | Emulsion | Mixing ratio | Projection area ratio |
|---|---|---|---|
| 1 | Emulsion C | 100% | — |
| 2 | Em - 1 | 100% | — |
| 3 | Em - 2 | 100% | — |
| 4 | Em - 3 | 65% | 100% |
| | Emulsion C | 35% | 48% |
| 5 | Em - 3 | 65% | 100% |
| | Em - 4 | 35% | 16% |
| 6 | Em - 3 | 65% | 100% |
| | Em - 5 | 35% | 11% |
| 7 | Em - 3 | 65% | 100% |
| | Em - 6 | 35% | 11% |
| 8 | Em - 3 | 60% | 100% |
| | Em - 7 | 40% | 8% |
| 9 | Em - 1 | 65% | 100% |
| | Em - 6 | 35% | 7% |
| 10 | Em - 2 | 65% | 100% |

TABLE 3-continued

| Sample No. | Emulsion | Mixing ratio | Projection area ratio |
|---|---|---|---|
| | Em - 6 | 35% | 9% |

*Expressed as a value relative to the value of an emulsion grain which had a large projection area (set as 100)

Each of Samples 1 to 10 was exposed to white light through an optical wedge, and processed under the following conditions:

Besides the standard color development time (3 min. 15 sec.), development times shorter by 30 seconds and longer by 30 seconds than the standard development time were also employed to examine the influence of a change in development time on photographic properties (a test in substitution for a test which examines the influence of a change in the activity of a processing liquid on photographic properties).

Processing procedures (38° C.)

| | | |
|---|---|---|
| Color development | Standard | 3 minutes 15 seconds |
| Bleaching | | 6 minutes 30 seconds |
| Rinsing | | 3 minutes 15 seconds |
| Fixing | | 6 minutes 30 seconds |
| Rinsing | | 3 minutes 15 seconds |
| Stabilizing | | 1 minutes 30 seconds |
| Drying | | |

Processing solutions for these processing procedures had the following compositions:

Color developer

| | |
|---|---|
| 4-Amino-3-methyl-N-ethyl-(β-hydroxyethyl)-aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |

Water was added to make a total quantity 1 l.

Bleacher

| | |
|---|---|
| Ferric ammonium ethylenediaminetetraacetate | 100 g |
| Diammonium ethylenediaminetetraacetate | 10.0 g |
| Ammonium bromide | 150.0 g |
| Glacial acetic acid | 10.0 ml |

Water was added to make a total quantity 1 l and ammonia was added to adjust pH to 6.0.

Fixer

| | |
|---|---|
| Ammonium thiosulfate | 175.0 g |
| Anhydrous sodium sulfite | 8.5 g |
| Sodium metasulfite | 2.3 g |

Water was added to make a total quantity 1 l and acetic acid was added to adjust pH to 6.0.

Stabilizer

| | |
|---|---|
| Formalin (37% aqueous solution) | 1.5 ml |
| Konidax (manufactured by Konica Corp.) | 7.5 ml |

Water was added to make a total quantity 1 l.

For each sample, fog density, relative sensitivity, gamma value and graininess were examined using green light and red light. The influence of a change in development time on sensitivity was also examined for the green-sensitive layer of each sample. The results are shown in Table 4.

Sensitivity is defined as the reciprocal of an exposure amount giving an optical density which exceeds a fog density by 0.3, and expressed as a value relative to a sensitivity of Sample 1 obtained when development was performed for 3 minutes 15 seconds (standard), which was set as 100.

Graininess (RMS value) is defined as the standard deviation of the variation of density occurring when an image having an optical density exceeding the minimum density by 0.3 is scanned with a microdensitometer of 250 μm in circular scanning diameter, and expressed as a relative value. A smaller RMS means improved graininess.

The gradation linearity of an image obtained by the standard processing was examined, and evaluated according to the following criterion:

D—The low-sensitive layer and the high-sensitive layer were different in gamma value by not less than 15%.

C—The low-sensitive layer and the high-sensitive layer were different in gamma value by not less than 10% but smaller than 15%.

B—The low-sensitive layer and the high-sensitive layer were different in gamma value by not less than 5% but smaller than 10%.

A—The low-sensitive layer and the high-sensitive layer were different in gamma value by smaller than 5%.

TABLE 4

| | Development Color development time | | | | | | | | | | |
|---|---|---|---|---|---|---|---|---|---|---|---|
| | 2 min. 45 sec. | | | 3 min. 15 sec. | | | | | 3 min. 45 sec. | | |
| | Properties | | | | | | | | | | |
| Sample No. | Fog | Change in sensitivity | Gamma value | Fog | relative sensitivity | Gamma value | Gradation linearity | RMS | Fog | Change in sensitivity | Gamma value |
| 1 (Comparative) | 0.11 | −30% | 0.57 | 0.15 | 100 | 0.64 | D | 100 | 0.20 | −10% | 0.73 |
| 2 (Comparative) | 0.11 | −30% | 0.58 | 0.14 | 110 | 0.66 | D | 94 | 0.19 | −10% | 0.73 |
| 3 (Comparative) | 0.11 | −30% | 0.58 | 0.14 | 115 | 0.66 | D | 93 | 0.19 | −10% | 0.73 |
| 4 (Comparative) | 0.13 | −20% | 0.59 | 0.16 | 95 | 0.67 | C | 103 | 0.20 | −8% | 0.74 |
| 5 (Inventive) | 0.10 | −15% | 0.62 | 0.12 | 105 | 0.68 | B | 98 | 0.16 | −6% | 0.73 |
| 6 (Inventive) | 0.10 | −15% | 0.62 | 0.12 | 105 | 0.68 | B | 96 | 0.16 | −6% | 0.73 |
| 7 (Inventive) | 0.10 | −12% | 0.64 | 0.12 | 115 | 0.68 | B | 95 | 0.14 | −5% | 0.70 |
| 8 (Inventive) | 0.10 | −10% | 0.65 | 0.12 | 115 | 0.68 | A | 94 | 0.14 | −4% | 0.70 |
| 9 (Inventive) | 0.10 | −15% | 0.63 | 0.12 | 110 | 0.68 | B | 97 | 0.15 | −7% | 0.72 |
| 10 (Inventive) | 0.10 | −14% | 0.62 | 0.12 | 110 | 0.68 | B | 96 | 0.15 | −6% | 0.71 |

As is understood from Table 3, Samples 5 to 10 (inventive) were not only excellent in sensitivity and graininess but also remarkably improved in gradation linearity and the stability of photographic properties (sensitivity, fog, gamma value) against the variation of the processing conditions.

The effects of the invention were produced more satisfactorily in the case of samples in which the average projection area of the core/shell type grains accounted for not more than 15% of that of the tabular grains (comparison between Sample 5 and other inventive samples).

Further, the effects of the invention were produced more satisfactorily when Emulsion (b) comprised octahedral grains (comparison between Samples 6 and 7).

Similar results were obtained for the red- and green-sensitive layers.

What is claimed is:

1. A silver halide photographic light-sensitive material having a support and provided thereon a blue-sensitive emulsion layer, a green-sensitive emulsion layer and a red-sensitive emulsion layer, wherein at least one of said color-sensitive emulsion layers comprises (a) tabular silver halide grains having an average aspect ratio of grain diameter to grain thickness of not less than 1.2; and (b) core/shell type regular crystal silver halide grains of which the average projection area accounts for not more than 40% of that of said tabular silver halide grains.

2. A silver halide photographic light-sensitive material of claim 1, wherein said tabular silver halide grains (a) have an average aspect ratio of 1.5 to 20.

3. A silver halide photographic light-sensitive material of claim 2, wherein said grains (a) have an average aspect ratio of 1.8 to 10.

4. A silver halide photographic light-sensitive material of claim 3, wherein said grains (a) have an average aspect ratio of 1.8 to 5.

5. A silver halide photographic light-sensitive material of claim 1, wherein the average diameter of said tabular silver halide grains (a) is 0.6 to 8 μm.

6. A silver halide photographic light-sensitive material of claim 1, wherein said tabular silver halide grains (a) are silver iodobromide or silver bromide.

7. A silver halide photographic light-sensitive material of claim 1, wherein said tabular grains (a) are silver halide grains in each of which silver iodide is localized in the central portion thereof.

8. A silver halide photographic light-sensitive material of claim 1 or 7, wherein the maximum value of silver iodide content at a portion of not more than 80% away from the center of said tabular grain in the diameter direction is within the range of 10 to 40 mol %.

9. A silver halide photographic light-sensitive material of claim 8, wherein said maximum value of silver iodide content is within the range of 15 to 35 mol %.

10. A silver halide photographic light-sensitive material of claim 1 or 7, wherein the average value of silver iodide content at the portion of more than 80% away from the center of said tabular grain in the diameter direction is within the range of 0 to 6 mol %.

11. A silver halide photographic light-sensitive material of claim 1, wherein said tabular silver halide grains (a) each have a silver iodide content of 4 to 12 mol %.

12. A silver halide photographic light-sensitive material of claim 1, wherein said core/shell type regular crystal silver halide grains (b) have a regular cubic, octahedral, dodecahedral, tetradecahedral or trisoctahedral form.

13. A silver halide photographic light-sensitive material of claim 1, wherein said regular crystal grains (b) each have a proportion of (111) face of not less than 70%.

14. A silver halide photographic light-sensitive material of claim 1, wherein said core/shell type regular crystal grains (b) each have the layer structure consisting of a core and a shell each different in silver iodide content.

15. A silver halide photographic light-sensitive material of claim 14, wherein said core has a silver iodide content of 20 to 40 mol %.

16. A silver halide photographic light-sensitive material of claim 14, wherein the outermost layer of said shell has a silver iodide content of 0 to 4 mol %.

17. A silver halide photographic light-sensitive material of claim 1, wherein said core/shell type silver halide grains (b) have a silver iodide content of 5 to 15 mol %.

18. A silver halide photographic light-sensitive material of claim 1, wherein said core/shell type silver halide grains (b) have an average diameter of 0.3 to 2 μm.

19. A silver halide photographic light-sensitive material of claim 1, wherein the average projection area of said silver halide grains (b) accounts for 1 to 35% of that of said tabular grains (a).

20. A silver halide photographic light-sensitive material of claim 19, wherein the average projection area of said grains (b) accounts for 3 to 20% of that of said grains (a).

21. A silver halide photographic light-sensitive material of claim 20, wherein the average projection area of said grains (b) accounts for 5 to 15% of that of said grains (a).

22. A silver halide photographic light-sensitive material of claim 1, wherein the silver weight of said grains (b) is in a proportion of less than 80% to the mixture of grains.

23. A silver halide photographic light-sensitive material of claim 22, wherein said proportion is less than 60%.

24. A silver halide photographic light-sensitive material of claim 23, wherein said proportion is from 5 to 50%.

* * * * *